United States Patent [19]

Frech

[11] 3,971,324

[45] July 27, 1976

[54] AUTOMATICALLY ACTUATED SUSPENDED RAILWAY CABIN CLOSURES

[76] Inventor: Anton Frech, Schongrund 21, 4600 Olten, Switzerland

[22] Filed: Mar. 18, 1974

[21] Appl. No.: 452,435

[30] Foreign Application Priority Data

July 17, 1973 Switzerland ..... 10366/73

[52] U.S. Cl. ..... 104/28; 104/93; 105/150; 105/329 S; 105/341

[51] Int. Cl.[2] ..... B61B 1/02; B61B 3/00; B61B 7/06; B61D 19/00

[58] Field of Search ..... 104/28, 93; 105/150, 105/341, 329 S; 188/2 D

[56] References Cited

UNITED STATES PATENTS

| | | | |
|---|---|---|---|
| 1,301,736 | 4/1919 | Pierce | 105/341 |
| 1,511,012 | 10/1924 | Adkins et al. | 105/341 |
| 2,317,363 | 4/1943 | Dahl | 105/341 |
| 3,556,016 | 1/1971 | Pomagalski et al. | 105/150 |

FOREIGN PATENTS OR APPLICATIONS

| | | | |
|---|---|---|---|
| 14,402 | 5/1898 | United Kingdom | 188/2 D |

*Primary Examiner*—Robert J. Spar
*Assistant Examiner*—Howard Beltran
*Attorney, Agent, or Firm*—Werner W. Kleeman

[57] ABSTRACT

A cable transport system for cabins wherein at each station there are secured two control rails and wherein each cabin comprises a door which, in its closed condition, is locked by a locking mechanism, the door being operatively connected with an actuation lever at which there engages one end of a tensioning device which in an intermediate position of the door intersects an extension of the axis of rotation of the actuation lever. A feeler element is connected with a control element, the feeler element, upon scanning the control rails, moving the control element from one terminal position into another terminal position, the door being opened in one terminal position and closed in the other terminal position. The control element comprises a carriage which can be displaced along a guide rail fixedly connected with the cabin. The carriage at a location between its two terminal positions unlocking the locking mechanism of the door through the agency of an unlocking element, and said carriage is operatively connected with the other end of the tensioning device.

7 Claims, 17 Drawing Figures

Fig. 1
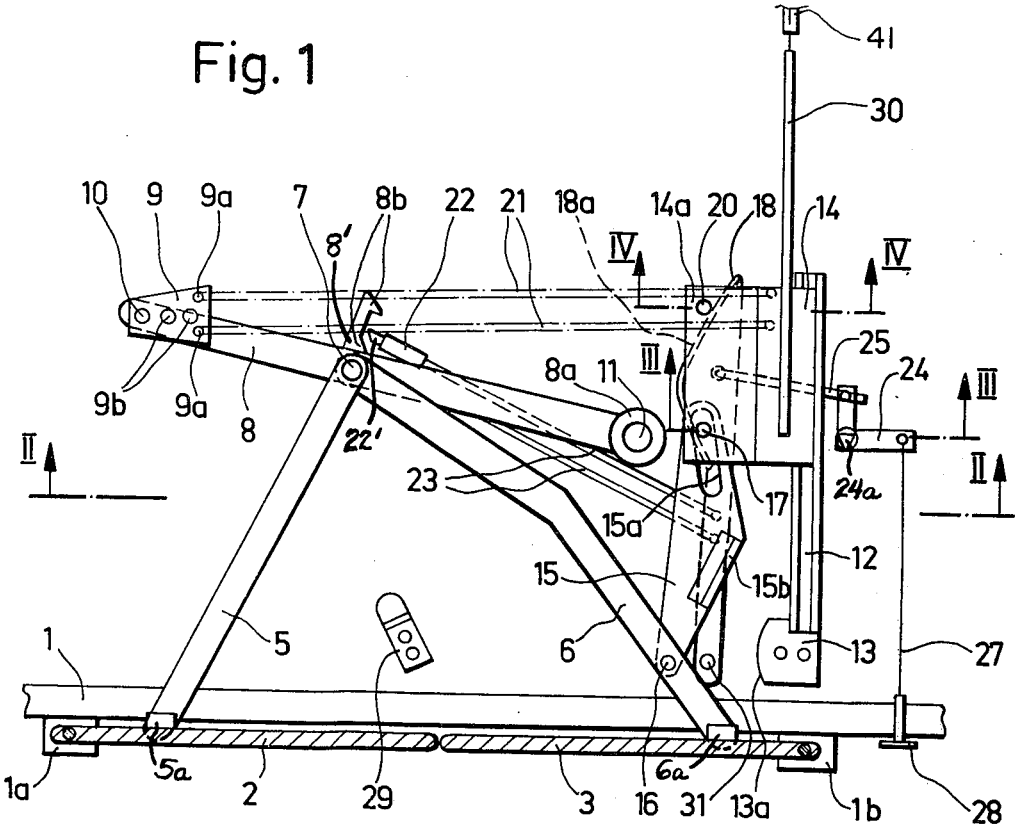
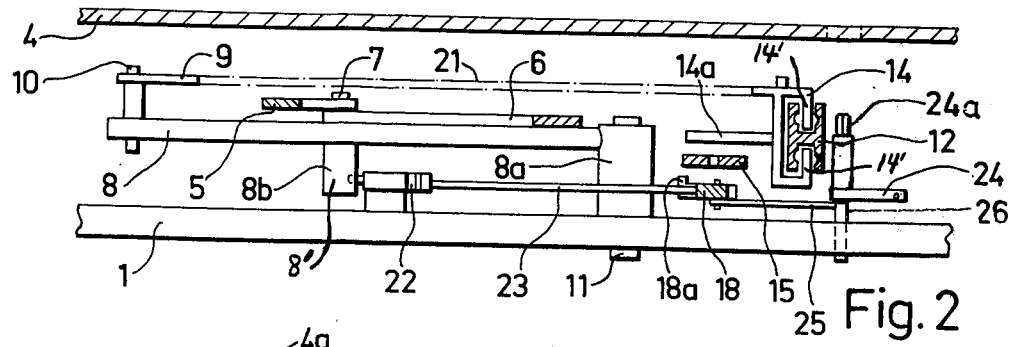
Fig. 2
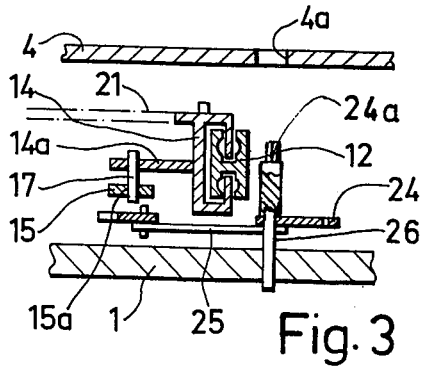
Fig. 3
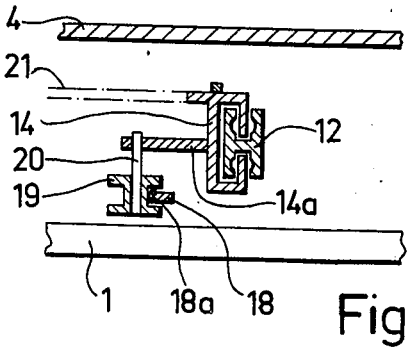
Fig. 4

Fig.4a
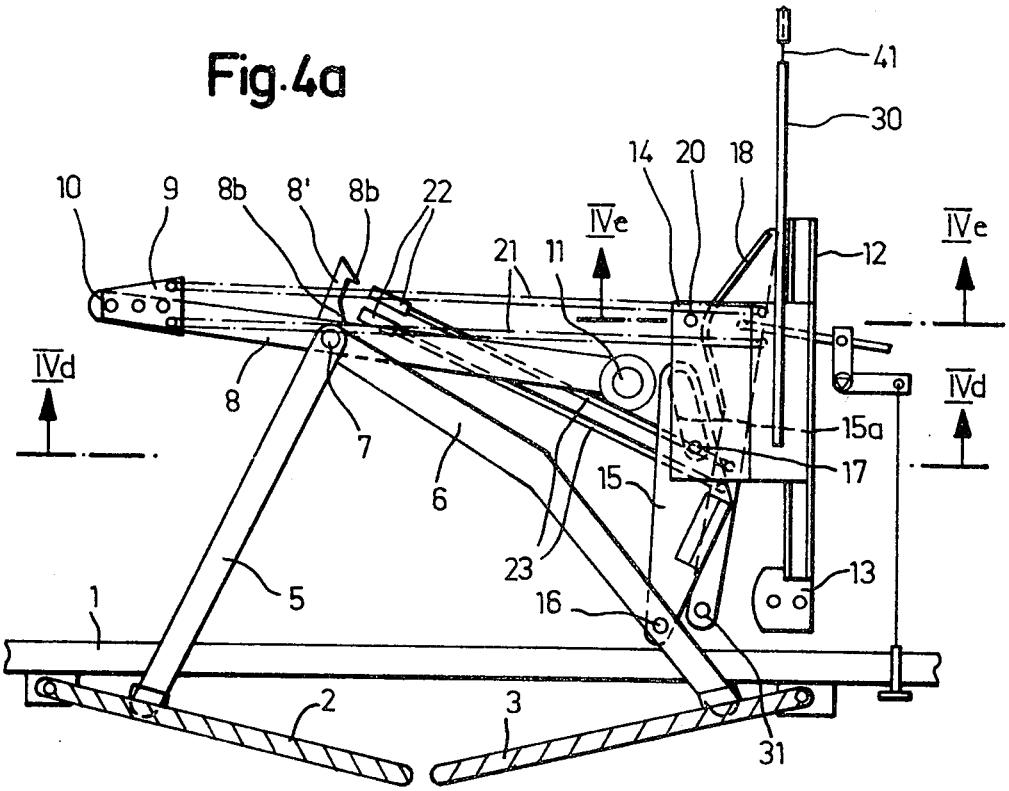
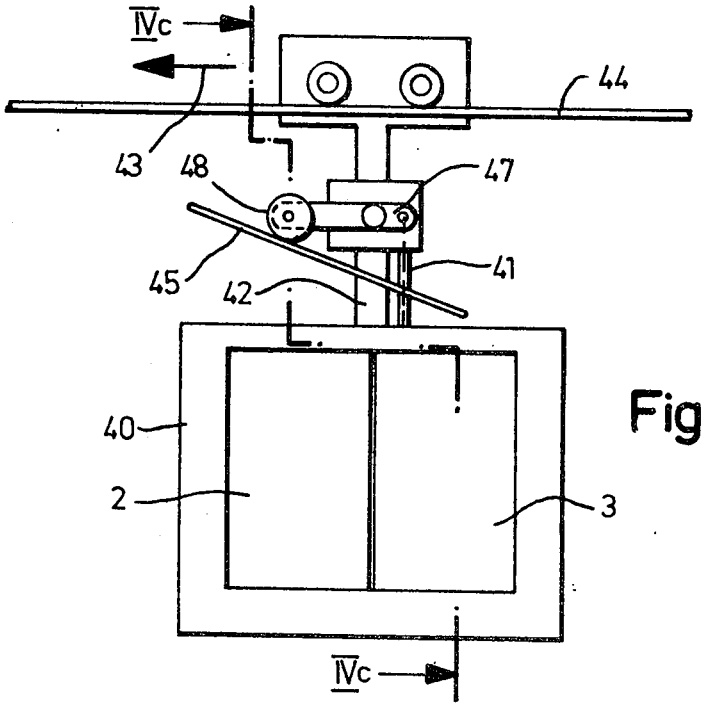
Fig.4b

Fig. 5
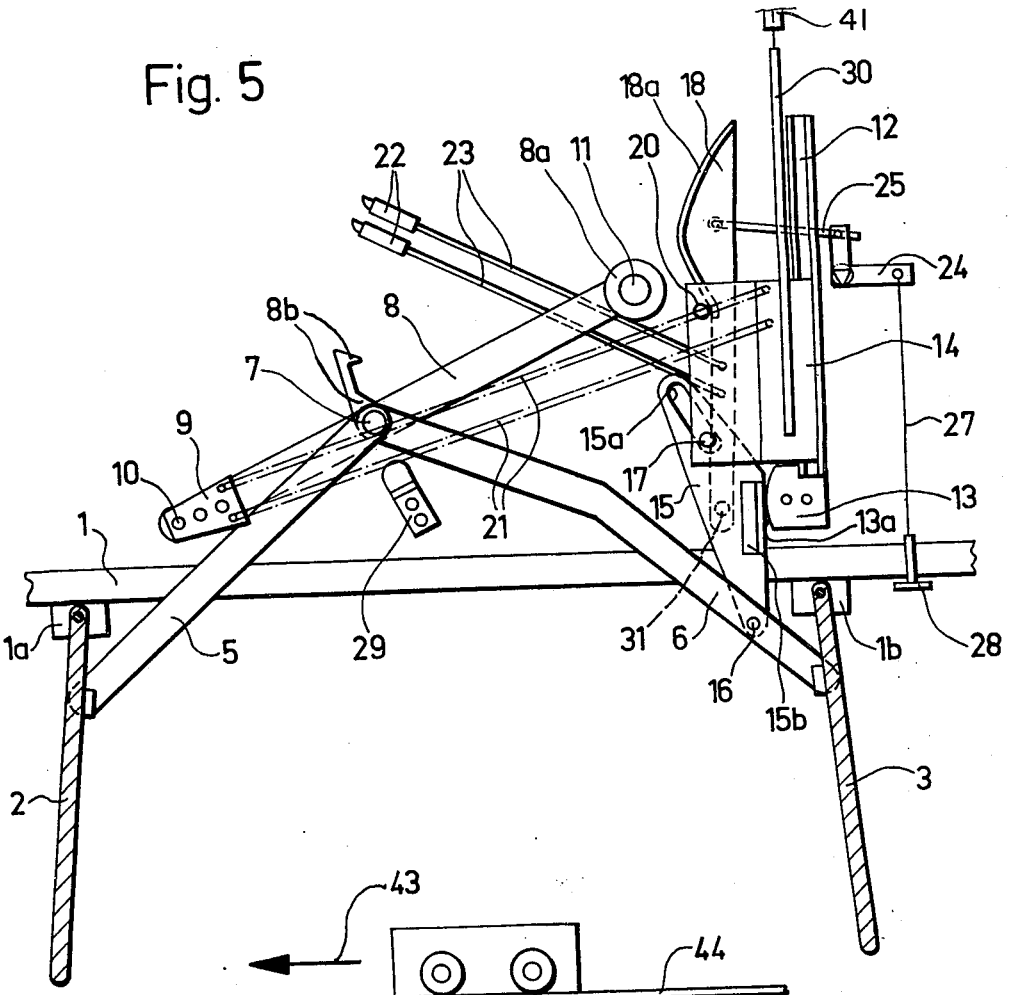
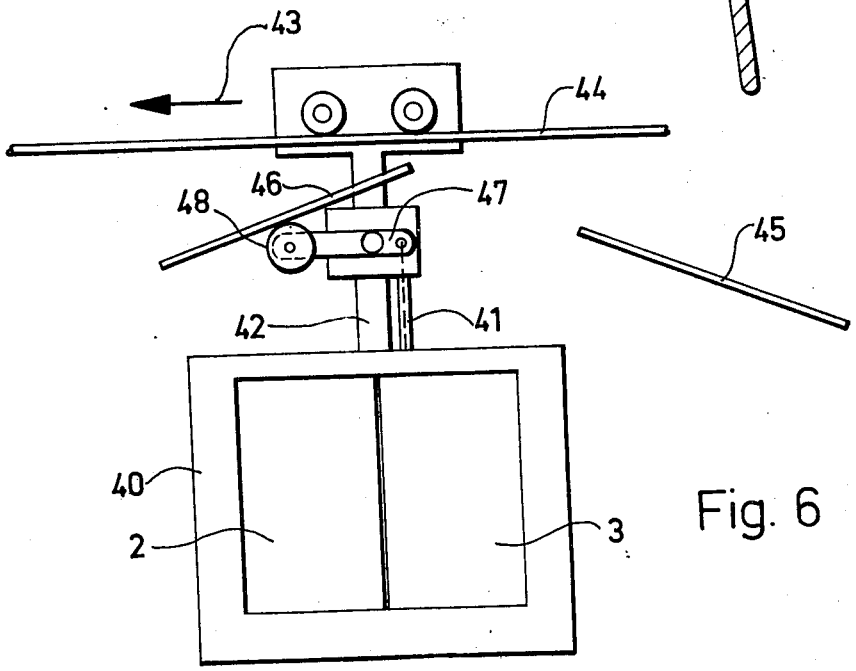
Fig. 6

AUTOMATICALLY ACTUATED SUSPENDED RAILWAY CABIN CLOSURES

BACKGROUND OF THE INVENTION

The present invention relates to a new and improved construction of cabin transport system wherein at such station there is secured at least one control rail and each cabin possesses a door which in its closed state or position is locked by a locking mechanism and which is operatively coupled with an actuation lever at which there engages one end of a tension or tensioning device, which tensioning device is an intermediate position of the door intersects an extension of the axis of rotation of the actuation lever, and further there is provided a feeler element connected with a control element, the feeler element upon scanning the control rail moving the control element from one terminal position into another terminal position, the door being opened in one terminal position and closed in the other terminal position.

The cabin transport system of this development can be used, for instance, as an upright cableway, aerial cableway or elevated railway, just to mention a few of the more common possibilities.

Cable transport systems for cabins of the general construction noted above, the cabin of which is automatically opened upon arrival at a station and upon departing from such station is again automatically closed and locked, have the advantage that the cabin need not be accompanied by an operator and also at the various stations it is not necessary to provide any personnel for opening and closing the cabin doors.

According to a known cabin transport system or telpher car, for instance as exemplified in U.S. Pat. No. 3,556,016, the cabin wall is formed of a bipartite shell. Both of the shell portions are fixed by means of hinges at a vertical support and can be outwardly swung open. The opening and closing of the shell is undertaken by means of a control lever arranged above the cabin which through the agency of a spring-loaded lever mechanism engages with the components of the shell. Since with this prior art construction it is necessary that practically the entire cabin wall must be swung open and closed at the stations, there is present a certain danger that accidents can occur for those persons leaning against the wall or located at the neighborhood thereof. This is especially the case because the shells, upon arrival at the station, are automatically swung open until reaching the terminal position. Since the shell forms the entire wall of the cabin it is relatively heavy, so that the swinging open and swinging shut of the shell requires a correspondingly great amount of force. Moreover, the control lever must be moved over a dead-center position, so that it is not readily possible to manually close the cabin.

According to a further prior art construction of cabin transport system the cabins are equipped with a single- or double-wing door and a door actuation mechanism which is arranged beneath the floor of the cabin. Opening of the door occurs through the agency of a control lever which is subjected to the action of a tension spring, this control lever being rocked or pivoted by means of a stationary control rail upon arrival at the station. However, this state-of-the-art construction is associated with the disadvantage that the tension spring must be relatively strongly tensioned upon exceeding the dead-center position. Therefore, the opening and closing of the door occurs quite suddenly and requires a relatively large amount of force, constituting a disadvantage particularly when manually closing the doors. Additionally, this door actuation device requires a relatively large amount of space at the floor of the cabin.

SUMMARY OF THE INVENTION

Hence, it is a primary object of the present invention to provide an improved cabin transport system which is not associated with the aforementioned drawbacks and limitations of the prior art proposals.

Another and more specific object of the present invention aims at the provision of a new and improved construction of cabin transport system wherein the doors of the cabin are automatically closed with a uniform, gentle or soft motion.

Now in order to implement these and still further objects of the invention, which will become more readily apparent as the description proceeds, the cabin transport system of the previously mentioned type, according to this invention is manifested by the features that, the control element is constituted by a carriage which is displaceable along a guide track which is fixedly connected with the cabin, the carriage, at a location between both of its terminal positions, unlocking the locking mechanism of the door via an unlocking element and such carriage is connected with the second or other end of the tensioning or tension device.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a somewhat simplified top plan view of the door actuation mechanism under the floor of a cabin with a double-wing door shown in its closed position;

FIG. 2 is a cross-sectional elevation view of the actuating arrangement depicted in FIG. 1, taken substantially along the line II—II thereof;

FIG. 3 is a cross-sectional elevation view of the actuating arrangement depicted in FIG. 1, taken substantially along the line III—III thereof;

FIG. 4 is a cross-sectional elevation view of the actuating arrangement depicted in FIG. 1, taken substantially along the line IV—IV thereof;

FIG. 4*a*, 4*b*, 4*c*, 4*d* and 4*e* illustrate the cabin and its elements during travel into the station, wherein;

FIG. 4*a* is a top plan view corresponding to the showing of FIG. 1 with the doors partly open;

FIG. 4*b* is an elevation view corresponding to the showing of FIG. 1*a* with the roller engaging the opening rail;

FIG. 4*c* is a cross-sectional side elevation view along the line IV*c*—IV*c* of FIG. 4*b;*

FIG. 4*d* is a cross-sectional elevation view of the actuating arrangement along the line IV*d*—IV*d* of FIG. 4*a;*

FIG. 4*e* is a cross-sectional elevation view along the line IV*e*—IV*e* of FIG. 4*a;*

FIG. 5 illustrates in a top plan view the same elements as shown in FIG. 1, however this time with the door shown in its open position;

FIG. 6 is a front elevation view of a cabin wherein the feeler element is mounted at the cabin suspension system;

DETAILED DESCRIPTION OF THE PREFERRED EMBODIMENTS

Figure 1A:
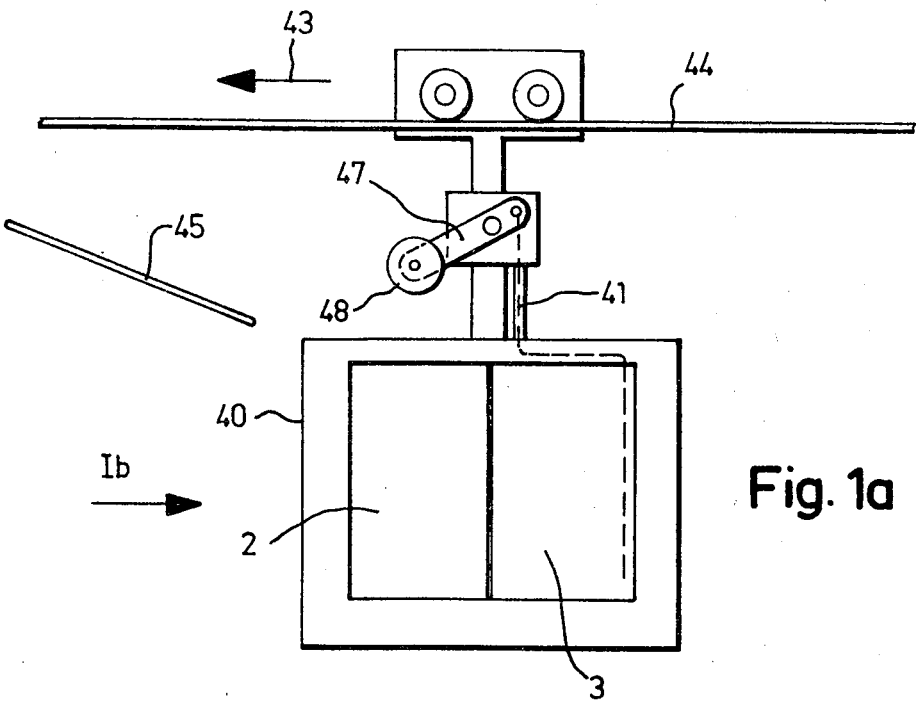
FIG 1*a* is a front elevation view of the cabin shortly prior to its arrival at the station.
Figure 1B:
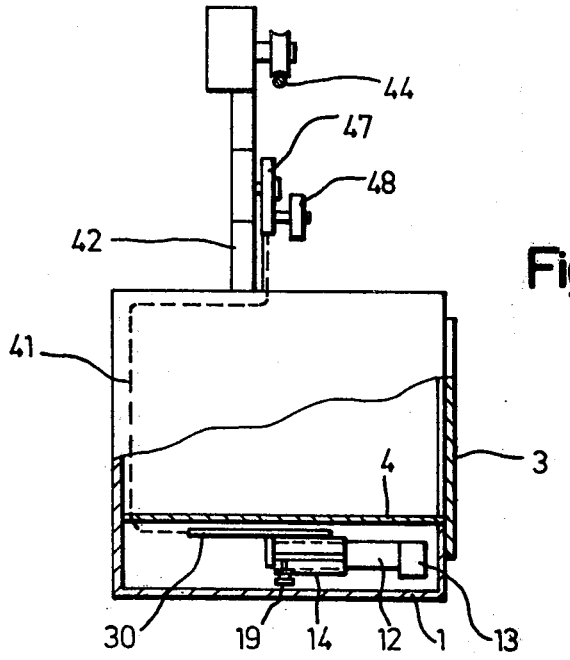
FIG. 1*b* is a side elevation view of the cabin portrayed in FIG. 1*a* looking in the direction of the arrow 1*b* thereof.

Describing now the drawings, in the exemplary embodiment depicted in FIGS. 1, 1*a*, 1*b*, 2, 3, 4, 4*a*, 4*b*, 4*c*, 4*d*, 4*e*, 5, 5*a*, 5*b*, and 6, wherein there are shown different plan views and sectional views of the cabin and door actuation mechanism, it is to be understood that a number of components which are not absolutely necessary for understanding the underlying concepts of the invention have been conveniently omitted from the drawings to improve upon the clarity and illustration. Hence, it will be recognized that the schematically indicated frame has been designated by reference numeral 1. Both of the door wings 2 and 3 of the door 2, 3 are pivotably mounted at hinges 1*a* and 1*b* respectively. In the exemplary embodiment under discussion the door actuation mechanism is arranged, for instance, beneath the cabin floor 4, although it also could be arranged at the ceiling or roof of such cabin.

A respective guide rod or link 5 and 6 is appropriately hingedly connected by means of the schematically depicted hinges 5*a* and 6*a* at each of the door wings 2 and 3. The other ends of both guide rods or links 5 and 6 are conjointly articulated by means of a bolt 7 or the like at an actuation lever 8. This actuation lever 8 possesses an eyelet 8*a* at one of its ends and is hingedly connected at that location by a bolt 11 at the frame 1. At the other free end of the actuation lever 8 there is hingedly connected a small plate or plate member 9. This plate 9 possesses three bores 9*b*, one of which has a pivot bolt 10 piercingly extending therethrough, and further possesses two bores 9*a* in which there are suspended one of the ends of the springs 21. The other ends of the springs or spring means 21 are suspended at two bores of a carriage 14. Plate 9 and the springs 21 collectively form a tensioning device which engages with the actuation lever 8.

Furthermore, a claw block 8' possessing two claws 8*b* is secured at the actuation lever 8. This claw block 8' together with a lock 22 forms a locking mechanism. The lock 22 possesses two locking elements or bolts 22' which are urged by means of not particularly illustrated springs against the claw block 8' and are configured such that when closing the door 2, 3 they automatically snap-in. The locking elements or bolts 22' are connected by two rods or tension springs 23 or equivalent structure with an unlocking element 18 constructed, for instance, as a lever and hingedly connected by means of a bolt 31 or the like at the frame 1. The carriage 14 which serves as a control element possesses two legs 14' which are guided by means of not particularly illustrated rollers or balls at a substantially H-shaped guide rail 12 which is fixedly connected with the frame 1 such that the carriage 14 can be displaced with very little friction along the guide rail 12. At the end of the guide rail 12 which confronts the door 2, 3 there is arranged a stop or impact member 13 with a rounded side or lateral surface 13*a*. The carriage 14 furthermore is equipped with a plate 14*a* at which there are secured two vertical bolts 17 and 20. A roller 19 is mounted upon the bolt 20, and bearing against roller 19 is a feeler or scanning surface 18*a* of the unlocking element 18. The other bolt 17 piercingly extends through a slot 15*a* of an arm 15 which is hingedly connected with the guide rod or link 6 at the region of the hinge connection 6*a* of the door wing 3 with such guide rod or link 6. As best seen by referring to FIG. 1 the carriage 14 is connected with play by means of the arm 15 with the link 6 and thus also with the door wing 3. At the arm 15 there is additionally secured an angle member 15*b*. Moreover, a stop or impact member 29 is attached to the frame 1, and which stop upon opening the door determines the end or terminal position of the actuation lever 8. Additionally, an emergency door opening device is also provided. The latter comprises an angle lever 24 which is mounted by means of a bolt 26 and which is equipped above its mounting position with a triangular member or portion 24*a*. The shorter leg of the angle lever 24 is connected with play via a guide rod or link 25 with the unlocking element 18 and the longer leg is connected via a tension cable 27 or the like with a handle or manual operating member 28.

The carriage 14 is connected via a rod 30 with one end of a Bowden cable or flexible ball chain 41 or the like to move said carriage in each direction. A Bowden cable is a well-known mechanism comprising a flexible wire core running in a flexible tube made of spirally wound wire, such as used, for example, to work, in both directions, hand-operated brakes on bicycles or the like. As best seen by referring to FIGS. 1*a*, 1*b*, 4*b*, 4*c*, 5*a*, 5*b* and 6 its other end is connected with a feeler element 47 constructed as a lever and arranged at the suspension system 42 of the cabin 40 which is supported by a support or carrier cable 44.

A feeler roller or roll 48 is mounted at the free end of the lever 47. By means of the feeler roller 48, upon travel into or departure from, respectively, the station it is possible to scan the stationary control rails 45 and 46.

Figure 4C:
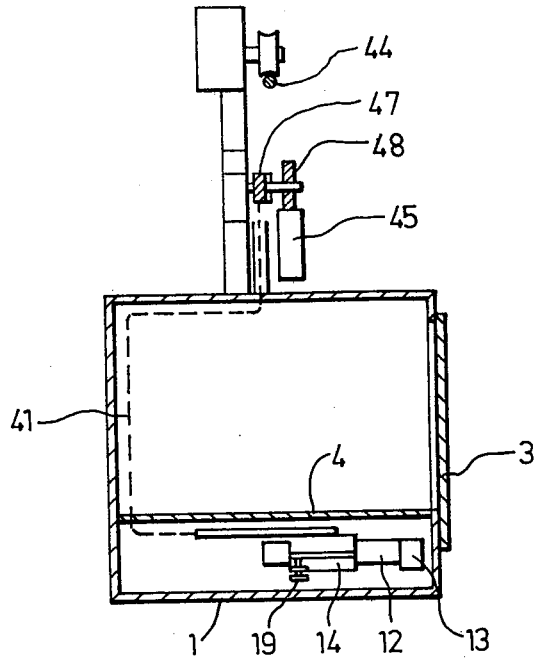
Figure 4D:
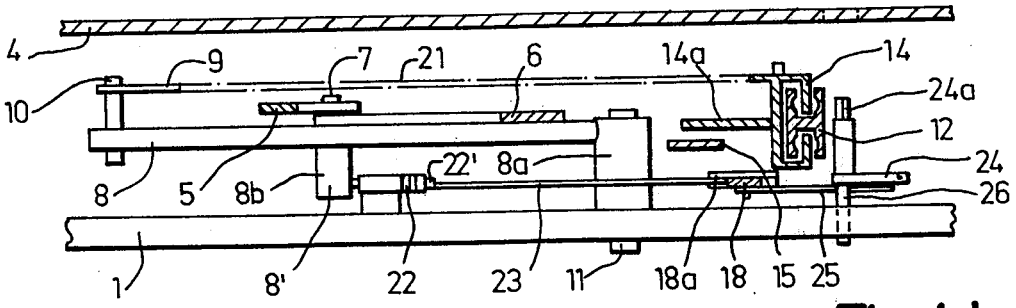
Figure 4E:
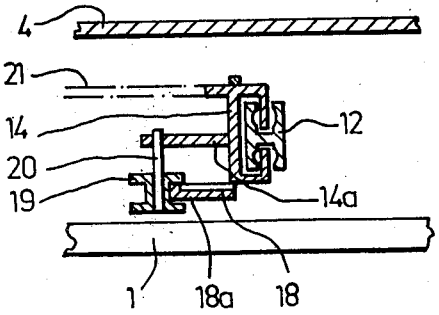
Figure 5A:
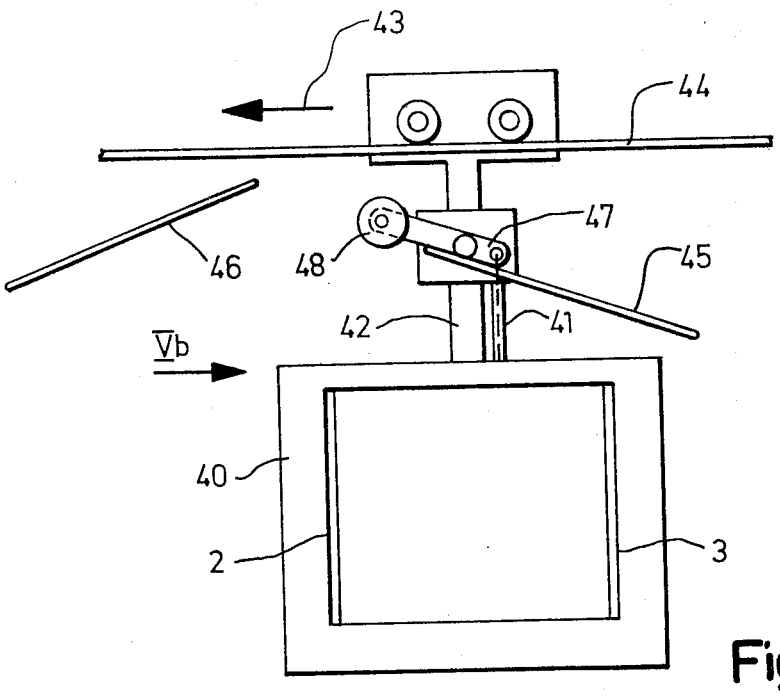
FIG. 5*a* is a front elevation view of the cabin similar to the showing of FIGS. 1*a* and 4*b* at the time that the cabin has arrived at the station and the doors have been opened.
Figure 5B:
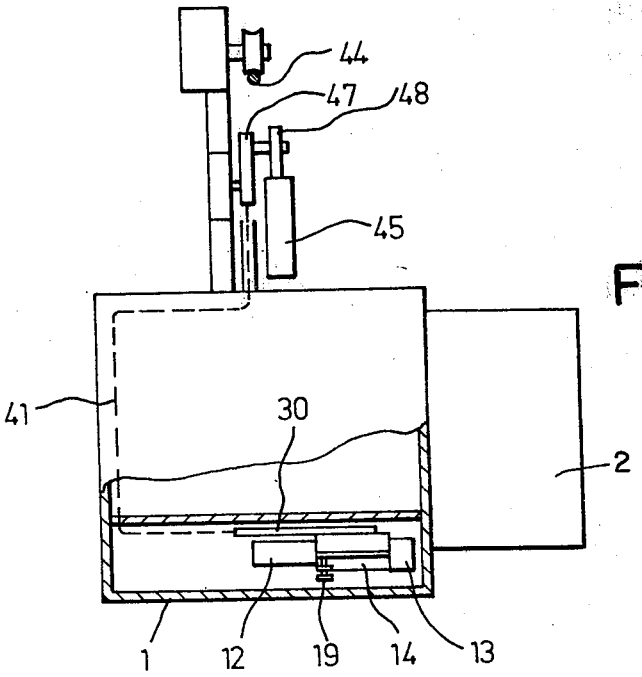
FIG. 5*b* is a side elevation view looking in the direction of the arrow V*b* of FIG. 5*a*, wherein part of the cabin has been broken away to reveal the internal structure thereof.

During travel of the cabin the cabin door 2, 3 is closed and locked by the locking mechanism 8*b*, 22. The door actuation mechanism at this time is located in the position shown in FIGS. 1, 1*a*, 1*b*, 2, 3, 4. Upon travelling into the station the feeler roller 48, as shown in FIG. 4*b*, is displaced or pushed upwards by the control rail 45 and the carriage 14 is shifted via the Bowden cable 41 along the guide rail 12 forwardly towards the cabin door. FIGS. 4*a*, 4*b*, 4*c*, 4*d*, 4*e* illustrate the position of the elements of the door actuation mechanism in an intermediate position during opening of the doors. As best seen by referring to FIGS. 4*a* and 4*c* the carriage 14 has already been placed up to almost the center of the guide rail 12. The roll or roller 19 secured by means of the bolt 20 (FIGS. 4*a*, 4*b*) at the carriage 14 now has rocked the unlocking element 18 in the clockwise direction. Consequently, the locking elements or bolts 22′ of the lock 22 are retracted and the actuation lever 8 is freed or released. During further displacement of the carriage 14 the locking element 18 under the action of springs contained in the lock and a possibly further spring directly engaging thereat, is again rocked back into its starting position. Further, the arm member or arm 15 forwardly pushes the guide rod or link 6. Consequently, the actuation lever 8 is rocked forwardly about the bolt 11 and the door 2, 3 is opened. Then when the door is about half open, that is to say, when the carriage 14 has moved past its intermediate position, which intermediate position is defined by the intersection of the axial extension of the bolt 11 and the line of symmetry of the tension or tensioning device 9, 21, then such opening of the door 2, 3 is assisted by such tensioning device and continued until the actuation lever 8 impacts against the stop 29. At the station the elements are then in the position of FIGS. 5, 5*a*, 5*b* and the feeler element 47 and therefore also the carriage 14 are freely movable and the door 2, 3 is resiliently held open by means of the tensioning device 9, 21. During travel out of the station in the direction indicated by the arrow 43 of FIG. 6, the feeler roller 48 is downwardly urged or pressed by the control rail 46 and now the carriage 14 is retracted. The elements of the door actuation mechanism thus arrive again in an intermediate position which approximately corresponds to the intermediate position illustrated in FIGS. 4*a*, 4*d*, 4*e*, however with the difference that the bolt 17 now is located at the rear end of the slot 15*a* and draws the arm 15 rearwardly. In so doing, the outer surface of the angle member 15*b* rolls upon or contacts the lateral surface 13*a* of the stop 13, and thus initiates the door closing operation. Consequently, the unlocking element 18 again is temporarily rocked. During closing this is however without any significance since the locks 22 are of course spring-loaded and also can be directly pushed back by the claws 8*b*.

As soon as the axis or line of symmetry of the tension or tensioning device 9, 21 is again located behind the extension of the axis of the bolt 11, then such door closing movement is assisted and completed by the tension device 9, 21. As best seen by referring to FIGS. 1 and 5 the springs 21, with the door 2, 3 closed and also with the door open, are approximately of the same length and are only slightly tensioned when moving through the dead-center position, so that opening and closing of the door 2, 3 occurs in a very gentle manner and uniformly. Consequently, the danger of accidents arising can be considerably reduced. The lock 22 and the claws 8*b* of the claw block 8′ are constructed such that, for instance, the door can be advantageously locked in three different positions (although it would be however possible to provide a greater number of positions), namely in a terminal position in which it is completely closed, and in two intermediate positions in which it is not yet completely closed. In this way there is achieved the result that also when closing the door and if, for instance, a ski or a hand of a skier should become caught, there is not present any danger that the door will again open. On the other hand, the arm 15 possesses so much play that, notwithstanding the fact that the carriage 14 during the respective automatic opening and closing of the cabin door is positively moved from the one terminal position into the other terminal position, still there is practically no danger of accidents if someone within or externally of the cabin stands too close to the door.

Of course it is possible to manually close the door already prior to departure of the cabin from the station. During closing of the door carriage 14 is displaced towards the rear by the arm or arm member 15. On the other hand, in the case of emergencies there is present the possibility of manually unlocking the locking mechanism 8*b*, 22 by rocking the angle lever 24. This can take place either from the inside of the cabin with the aid of a triangular key or equivalent device by means of an opening 4*a* provided at the cabin floor 4 or from the outside by pulling upon the handle or handgrip 28.

Now in order to be able to compensate the fatigue of the springs 21 which, as expected, arises during the course of operation of the cabin, the plate member 9 is equipped along its axis of symmetry with three identical sets of bores 9*a* (one set of which is shown). Thus, it is advantageous, as illustrated in FIGS. 1 and 2, to hingedly connect the springs initially at the forwardmost bores and later on when the spring tension gives to hingedly connect such springs further towards the rear.

Figure 7:
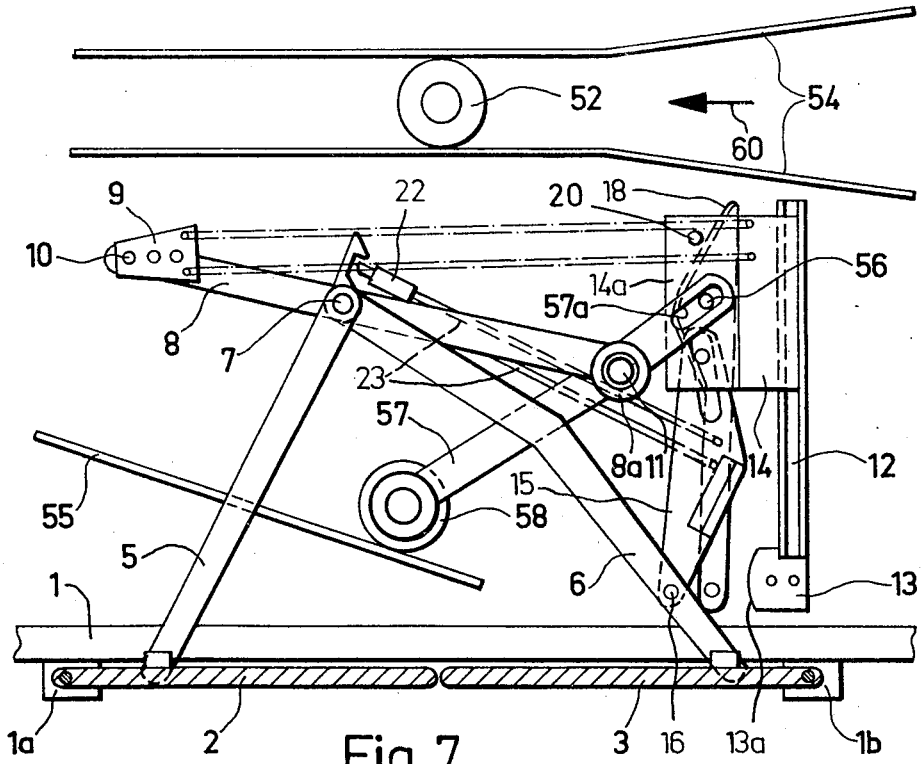
FIG. 7 is a markedly simplified top plan view of the door actuation mechanism under the floor of a cabin wherein the feeler element is arranged beneath the floor of the cabin.

FIG. 7 illustrates a plan view, analogous to the showing of FIG. 1, of a further constructional embodiment. To improve clarity in illustration a certain number of the components have been conveniently omitted. The feeler element 57 which is constructed as a double-arm lever, with this exemplary embodiment, is arranged beneath the cabin floor and is conjointly mounted with the actuation lever 8 by means of the bolt 11. This feeler or scanner element 57 is provided at one end with a slot 57*a* in which engages a pin 56 which is secured at the plate 14*a* of the carriage 14. At the other end there is mounted a feeler roller 58. When the cabin moves into the station, in the direction indicated by the arrow 60, then the control rail 55 upwardly displaces the feeler roller or roll 58. Consequently, the carriage 14 is shifted towards the front and the door is unlocked and opened analogous to what was discussed before. At the departure side of the station there is arranged a non-illustrated control rail (e.g. like rail 46 of FIG. 6) which is inclined in the reverse manner and which brings about closing and locking of the door. Furthermore, at the station there are provided two stationary rails 54 by means of which there is guided a roller 52 which is mounted at the frame of the cabin. In this way there can be prevented rocking of the cabin at the station. A comparable solution would be to provide a guide arrangement at the floor of the cabin for this purpose.

Figure 8:
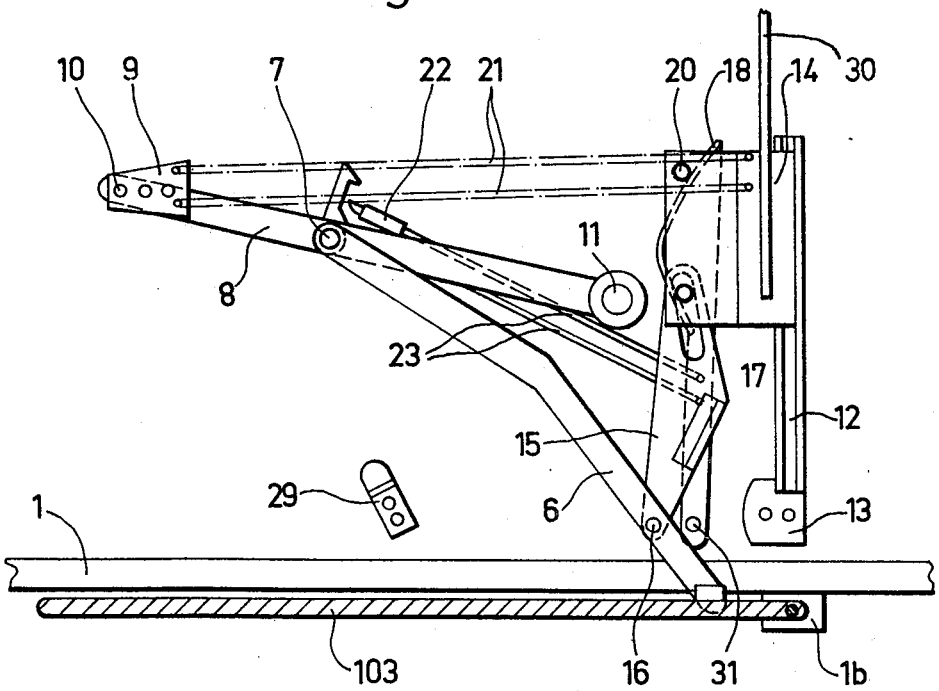
FIG. 8 is an illustration analogous to the showing of FIG. 1 under the floor of a cabin with a single-wing door.

FIG. 8 illustrates a further variant construction of the invention wherein the door only possesses a single wing 103. Of course, in this case there is omitted the guide rod or link 5 since is is obviously not needed.

Finally, it is to be appreciated that it would of course be possible to undertake many different modifications in the described exemplary constructions. For instance, the arm 15, instead of engaging at the link or guide rod 6, could engage directly at the door wing 3 or 103 respectively. Furthermore, the links 5 and 6, with the double-wing construction of cabin, also could be hingedly connected at different locations at the actuation lever 8.

While there is shown and described present preferred embodiments of the invention, it is to be distinctly understood that the invention is not limited thereto, but may be otherwise variously embodied and practiced within the scope of the following claims.

Accordingly, what is claimed is:

1. A cable transport system comprising two control rails secured at each station for a cabin, each cabin being provided with a cabin door, a locking mechanism for locking the cabin door when in its closed position, an actuation lever mounted for rotation about an axis of rotation and with which the door is operatively connected, a tension device having one end engaging with an end of the actuation lever, said tension device is an intermediate position of the door intersecting an extension of the axis of rotation of the actuation lever, a control element movable between two terminal positions, a feeler element connected with said control element, said feeler element during scanning of the control rails displacing the control element from one terminal position into the other terminal position, the cabin door being opened in one terminal position and closed in the other terminal position, said control element comprising a carriage, a guide rail fixedly connected with the cabin, said carriage being displaceable along said guide rail, an unlocking element cooperating with said locking mechanism, said carriage when assuming a position at a location between both of its terminal positions unlocking the locking mechanism of the cabin door via the unlocking element, said carriage being connected with the other end of the tension device.

2. The cable transport system as defined in claim 1, wherein said cabin door includes at least one door wing, link means for connecting the door wing with the actuation lever, and an arm member for connecting the door wing with play with the carriage.

3. The cable transport system as defined in claim 2, further including hinge means for hingedly connecting said link means with the door wing, and means for hingedly connecting said arm member with the link means at the region of the hinge connection of the door wing with the link means.

4. The cable transport system as defined in claim 1, wherein each cabin is equipped with a door having two door wings, said two door wings each being connected by a respective link means with the actuation lever.

5. The cable transport system as defined in claim 3, wherein each cable possesses a door having one door wing.

6. The cable transport system as defined in claim 1, wherein the feeler element is arranged above the roof of the cable and is connected via a Bowden cable with said carriage.

7. The cable transport system as defined in claim 1, wherein the feeler element is arranged beneath the floor of the cabin and is constructed as a lever which is operatively connected with said carriage.

* * * * *